US008181960B2

(12) United States Patent
Anderson

(10) Patent No.: US 8,181,960 B2
(45) Date of Patent: May 22, 2012

(54) RECIPROCALLY LINKED NESTING STRUCTURE

(76) Inventor: Nils Folke Anderson, Brooklyn, NY (US)

( * ) Notice: Subject to any disclaimer, the term of this patent is extended or adjusted under 35 U.S.C. 154(b) by 522 days.

(21) Appl. No.: 11/835,702

(22) Filed: Aug. 8, 2007

(65) Prior Publication Data

US 2009/0039599 A1 Feb. 12, 2009

Related U.S. Application Data

(63) Continuation-in-part of application No. 29/289,179, filed on Jul. 10, 2007, now Pat. No. Des. 590,742.

(51) Int. Cl.
*A63F 9/08* (2006.01)

(52) U.S. Cl. ..... 273/157 R; 273/155; 273/158; 273/159; 273/160; 446/487; 446/489; 446/491; 446/124; 446/125; 59/3; 59/80; 59/83

(58) Field of Classification Search ..... 273/155–160; 446/487, 489, 491; 59/3, 80, 83
See application file for complete search history.

(56) References Cited

U.S. PATENT DOCUMENTS 964,688 A * 7/1910 Parker ..... 273/158
977,265 A * 11/1910 Brethorst ..... 273/158
1,095,908 A * 5/1914 Messenger ..... 273/158
1,138,108 A * 5/1915 Hogl ..... 273/156
1,338,973 A * 5/1920 Brown ..... 273/158
1,972,128 A * 9/1934 Bobbroff ..... 63/15
D172,310 S * 5/1954 Riddle ..... D21/482
2,738,616 A * 3/1956 Windle ..... 446/267
2,859,971 A * 11/1958 Grant et al. ..... 273/158
3,695,617 A * 10/1972 Mogilner et al. ..... 273/156
3,758,114 A * 9/1973 Ludwig ..... 273/159
3,800,442 A * 4/1974 Petrocelli ..... 434/96
3,815,282 A 6/1974 Frost
3,885,793 A * 5/1975 Vaughn ..... 273/158
4,198,053 A * 4/1980 Rao ..... 273/160
4,643,427 A * 2/1987 Wozniak ..... 273/160
4,651,517 A * 3/1987 Benhamou et al. ..... 59/80
4,996,835 A * 3/1991 Rozenwasser ..... 59/80
5,114,377 A * 5/1992 Cove Mercuri et al. ..... 446/487
D328,318 S * 7/1992 Rhymer ..... D21/478
5,224,959 A * 7/1993 Kasper ..... 482/114
5,413,519 A * 5/1995 Simon ..... 446/487
5,542,244 A * 8/1996 Chia et al. ..... 59/35.1
5,566,937 A * 10/1996 Lorhpipat et al. ..... 473/612
5,660,036 A * 8/1997 Rozenwasser ..... 59/80
5,988,639 A * 11/1999 Seldin ..... 273/156
6,250,988 B1 * 6/2001 Fleet ..... 446/486
D472,183 S * 3/2003 Flohe ..... D11/131
6,568,982 B2 * 5/2003 Esterle ..... 446/122
6,783,815 B2 * 8/2004 Flohe ..... 428/11
6,846,216 B1 * 1/2005 Balanchi ..... 446/85
(Continued)

*Primary Examiner* — Gene Kim
*Assistant Examiner* — Alexander Niconovich
(74) *Attorney, Agent, or Firm* — Ronald Abramson; Hughes Hubbard & Reed LLP

(57) ABSTRACT

An assembly comprising three or more elements; each element comprises a shape with an opening completely through the element; and each element comprises a plurality of edges, the edges being joined together at angular junctions. Each element links all of the other elements, and each element links the other elements in the same way. The link is formed by a portion of the shape passing through the openings in the other elements, so that the elements form a nested structure, and the elements are interchangeable in the nested structure without altering the nested configuration of the assembly.

18 Claims, 2 Drawing Sheets

U.S. PATENT DOCUMENTS

| | | | | |
|---|---|---|---|---|
| D528,463 | S * | 9/2006 | Schobinger et al. | D11/141 |
| 7,127,842 | B2 * | 10/2006 | Murthy | 40/124.08 |
| 7,231,719 | B2 * | 6/2007 | Butcher | 30/196 |
| 7,484,732 | B2 * | 2/2009 | Adams | 273/157 R |
| D590,742 | S * | 4/2009 | Anderson | D11/131 |
| 7,867,115 | B2 * | 1/2011 | Zawitz | 473/570 |
| 2003/0037441 | A1 * | 2/2003 | Butcher | 30/233 |
| 2006/0279043 | A1 * | 12/2006 | Adams | 273/292 |

* cited by examiner

RECIPROCALLY LINKED NESTING STRUCTURE

CROSS-REFERENCE TO RELATED APPLICATION

This application claims the benefit of the U.S. Design patent application Ser. No. 29/289,179 ("Reciprocally Linked Nesting Structure"), filed on Jul. 10, 2007, which is hereby incorporated by reference.

BACKGROUND OF THE INVENTION

1. Field of the Invention

The invention concerns several fields, including industrial design, amusements and toys, architectural arts, sculptural arts, jewelry, furniture, chemistry and nanotechnology. In particular, it relates to structure formed by an assembly of reciprocally linked elements, which may be used in any of said fields.

2. Background of the Related Art

Objects made of a number of linked circular rings have been found in jewelry and toys.

SUMMARY OF THE INVENTION

The present invention concerns a reciprocally linked nesting structure. This structure is an assembly comprising three or more elements; each element comprises a shape with an opening completely through the element; and each element comprises a plurality of edges, the edges being joined together at angular junctions. Each element links all of the other elements, and each element links the other elements in the same way. The link is formed by a portion of the shape passing through the openings in the other elements, so that the elements form a nested structure, and the elements are interchangeable in the nested structure without altering the nested configuration of the assembly.

DETAILED DESCRIPTION

The following is a description of several preferred embodiments of various aspects of the invention. These embodiments are illustrative only. The invention is limited only by the scope of the claims which are appended hereto, and is by no means limited to particular examples described below.

The present invention concerns a reciprocally linked nesting structure. This structure is an assembly comprising three or more elements; each element comprises a shape with an opening completely through the element; and each element comprises a plurality of edges, the edges being joined together at angular junctions. Each element links all of the other elements, and each element links the other elements in the same way. The link is formed by a portion of the shape passing through the openings in the other elements, so that the elements form a nested structure, and the elements are interchangeable in the nested structure without altering the nested configuration of the assembly.

In this invention, the elements of the assembly can be of various shapes. In one embodiment, the elements are all identical to each other in shape. Some examples of shapes are triangles, squares, pentagons, hexagons, etc.

The edges of the elements can (but need not) be straight; also any number of the edges can (but again need not) have flat sides. Furthermore, the elements can be planar or non-planar. For non-planar elements, the elements may have chiral asymmetry, and a combination of right-handed and left-handed elements (i.e., elements of opposite chirality) can be used together in the assembly.

Figure 1:
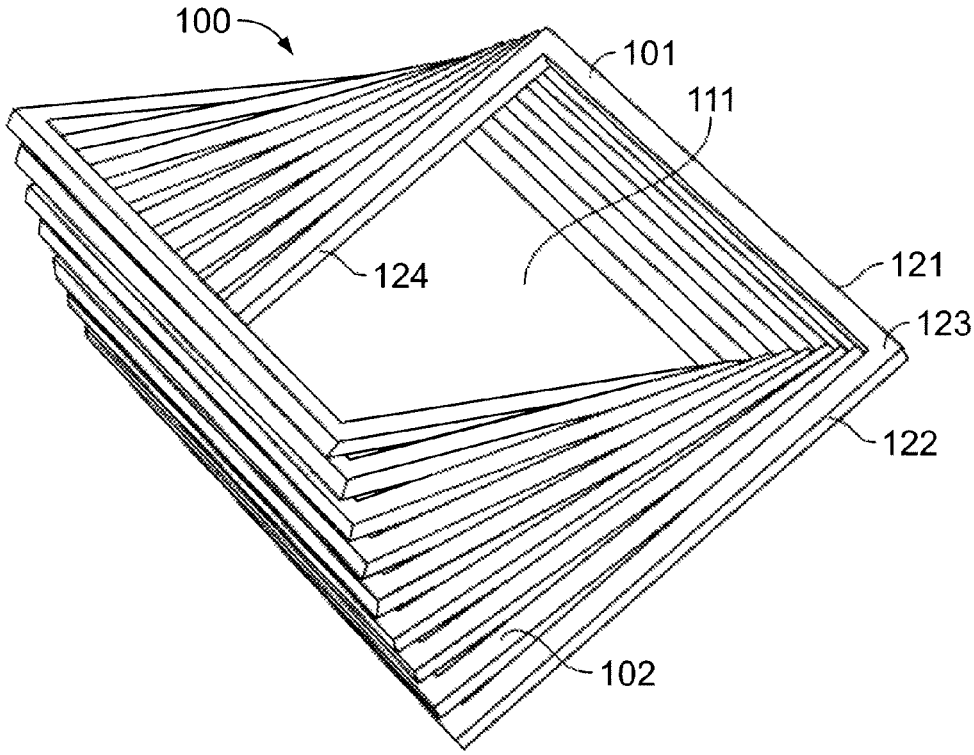
FIG. 1 shows an exemplary assembly in a completely nested conformation.

As shown in FIG. 1, a completely nested structure 100 is formed with nine (9) square-shaped elements 101, etc. orderly stacked together. Each element (101, 102, etc.) comprises a shape, in this case a square, with an opening 111, etc. completely through the element. In this example, the opening is the central portion of the frame-like structure formed by this type of element. Each element (101, etc.) comprises a plurality of edges 121, 122 etc., the edges being joined together at angular junctions 123, etc. Each element (e.g., 101) links all of the other elements (e.g., 102, etc.), and each element links the other elements in the same way. The link is formed by a portion of the shape (e.g., edge 124 of element 101) passing through the openings in the other elements (102, etc.), so that the elements may form a nested structure, as shown in FIG. 1. The elements are interchangeable in the nested structure without altering the nested configuration of the assembly. With reference to FIG. 1, this means that the elements shown can be rearranged in any order and re-nested so as to have exactly the same conformation illustrated in FIG. 1.

Figure 2:
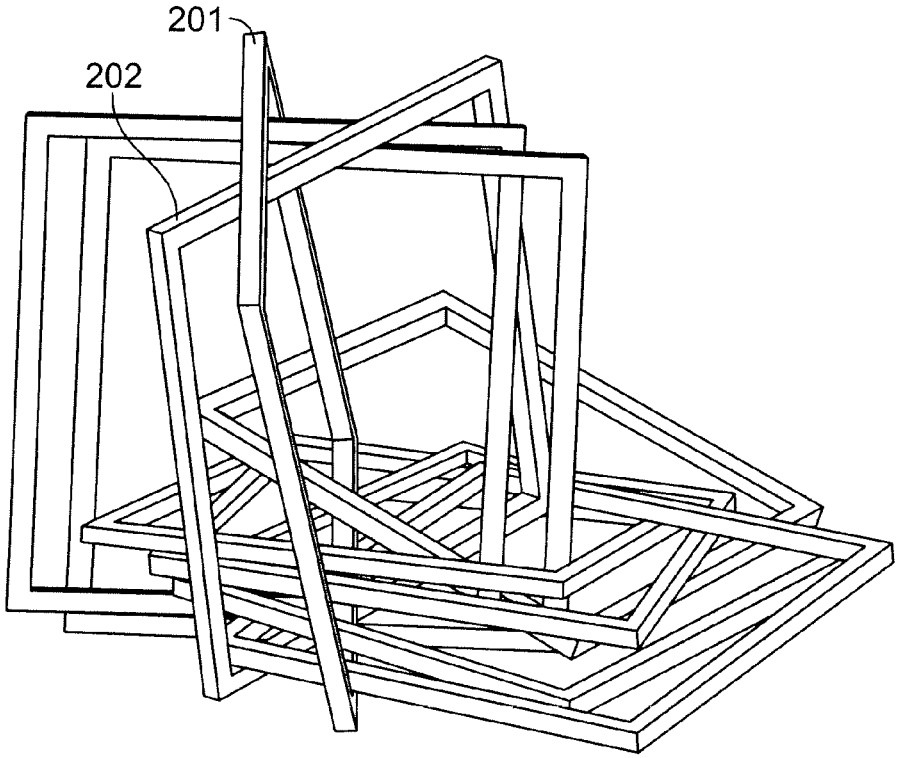
FIG. 2 shows the assembly of FIG. 1 in an un-nested conformation.

As shown in FIG. 2, the assembly can be in an un-nested form, where at least one edge of at least one element (e.g., 201) is constrained from moving as a result of contact with a structure representing one of the set of the angular junction of another element, an edge of another element, or an intersection of edges of two or more other elements (e.g., the top edge of element 202). It should be understood that the assembly shown in FIG. 2 is identical to that shown in FIG. 1 except for its arrangement by way of conformation. There are in infinite number of un-nested conformations for any given assembly.

The assembly can be used as an input device, by incorporating means (such as gyroscopic and accelerometer means) to track the positions of the elements so that the assembly may be used as an input device for a 3D imaging device.

The assembly can be made from various materials, and of various sizes, and can be used for various purposes, such as architectural designs, sculptural designs, furniture, jewelry, etc.

In accordance with another aspect of the invention, a molecular structure can be formed by a number of molecular rings that are reciprocally linked together. The chemical bonds in such structures provide edges and angular junctions, which when joined in a ring thereby provide linkable elements in accordance with the invention. Structures providing assemblies in accordance with the invention at a molecular or slightly larger scale, for example, in which the elements are nanotubes (and including structures comprising a plurality of assemblies as described below), may be used for nanotechnological purposes.

The structure is not limited to a single assembly. A complex assembly can be formed by linking at least two assemblies together by at least one link. A complex assembly can also be formed by placing at least two assemblies that are in close proximity with each other, or are touching without actually linked together.

Another type of structure can be formed by applying a flexible cover over a plurality of the edges comprising the assembly. The flexible cover can later be hardened so that a structure remains even if the assembly is removed. Alternatively, a structure can be formed where the cover is affixed to a plurality of the edges comprising the assembly (in which case the cover need not be flexible (though it may be)). Such a covered structure might be used as an architectural element.

In one embodiment, an assembly in accordance with the invention can be made from a mold by standard casting techniques. in such a case, the elements of the assembly are first made out of burnable or meltable materials, such as Styrofoam. Upon forming a desired conformation of the assembly, the assembly is covered with casting material, such as cement, plaster or sand. Heat is applied so that the elements burn or melt away, leaving hollow members in the mold for casting.

It is not necessary to use the entire assembly. A structure can be formed by removing a portion of the assembly. Also, a portion of the assembly can be covered. For example, a portion of the assembly to be used architecturally or structurally may be buried in the foundation.

The reciprocally linked nesting structure can also be created in a computer, where the elements of the assembly can be manipulated by a computer animation program to form a desired structure and rendered on a graphical display.

Figure 3:
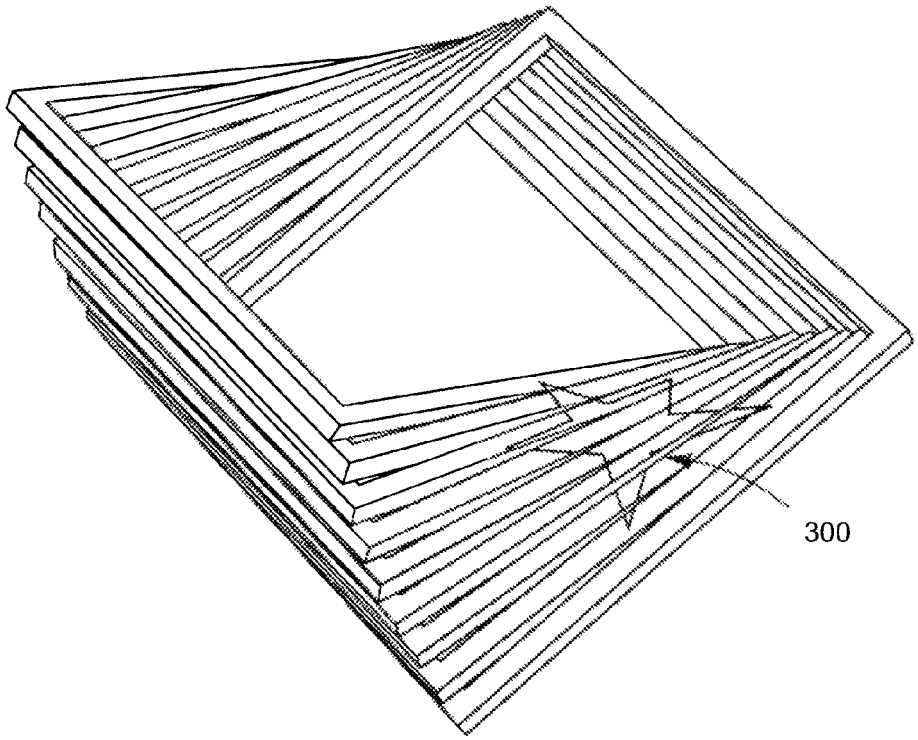
FIG. 3 shows a larger image appearing on an assembly when the elements are arranged in a certain order and in a completely nested conformation.
Figure 4:
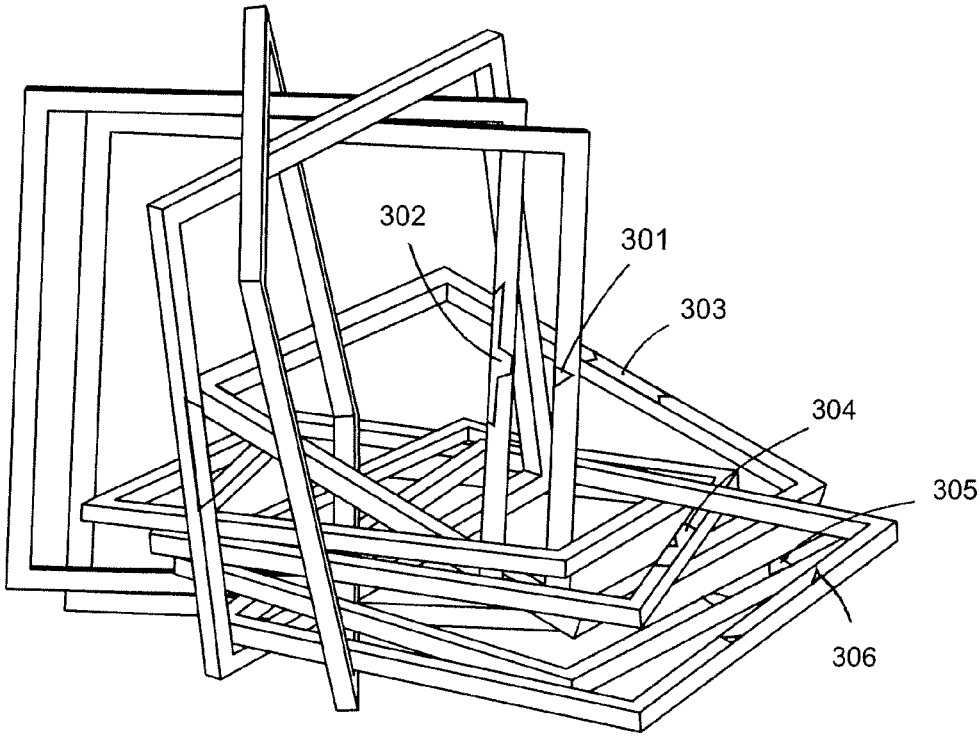
FIG. 4 shows pieces of the larger image on the elements of the assembly of FIG. 3 in an un-nested conformation.

The surfaces of the elements in an assembly can be colored, decorated, numbered or otherwise distinguished from one another. This can be done in such a way that when the elements are arranged in various orders that the decorations or colors coincide to form larger images or patterns. For example, a puzzle can be made from such an assembly where an image is revealed when all the elements are placed in the correct positions. An example of such puzzle is shown in FIG. 3, where a "Star" pattern 300 is formed when the elements of the assembly are arranged in a certain order and orderly stacked together in a nested conformation. However, as shown in FIG. 4, when the nested conformation is disturbed and/or the orders of the elements are changed, so that the assembly is now in an un-nested form, only pieces of the pattern (301, 302, 303, etc.) are revealed on some elements, and the original pattern is scrambled and becomes unrecognizable.

There are several alternative arrangements for the above decoration, for example: having multiple images on the various sides of the same configuration; using the same assembly in different configurations to represent different things (e.g. you get a sunset on one side, while arranging the same elements in another configuration yields a butterfly, or a pleasing abstract design, etc.); and breaking the various images/decorations into random configurations in which new and pleasing patterns are formed.

While the presently preferred embodiments have been described in detail, it will be apparent to those skilled in the art that the principles of the invention are realizable by other devices and methods without departing from the scope and spirit of the invention, as defined in the following claims.

I claim:

1. An assembly comprising three or more elements, wherein each element comprises a rigid shape with an opening completely through the element;

each element comprises a plurality of edge segments, the edge segments having a polygonal cross-section and being rigidly joined together at angular junctions and having at least two parallel substantially planar exterior surfaces extending between and forming a part of the angular junctions;

the assembly further comprising a nested configuration wherein:

each element links all of the other elements;

each element links the other elements in the same way;

the link for each element is formed by a single portion of each element passing once through each of the openings in the other elements;

each element is nested with another element in a common manner;

the elements are moveable between a first position and a second position in the nested configuration without altering the relative positioning of elements in the nested configuration of the assembly and without removal of any of the links, wherein in the first position an edge segment of a first element nests against an edge segment of a second element, and wherein in the second position the edge segment of the first element is nested against an edge segment of a third element and separated from the edge segment of the second element; and wherein, in the nested configuration, each element has at least one edge segment that contacts an edge segment of another element along substantially the entirety of the length of the one edge segment of the element and the one edge segment of the another element, and the one edge segment of the element is parallel to the one edge segment of the another element for the entire length of the contact between the one edge segment of the element and the one edge segment of the another element.

2. An assembly in accordance with claim 1, wherein one of more of said edge segments is linear.

3. An assembly in accordance with claim 1, wherein each of the exterior surfaces of said edges is substantially flat.

4. A structure comprising an assembly in accordance with claim 1 wherein said assembly is in a completely nested conformation.

5. A structure comprising an assembly in accordance with claim 1 wherein said assembly is in an un-nested conformation in which at least one edge segment of at least one element is constrained from moving as a result of contact with a structure representing one of the set of the angular junction of another element, an edge segment of another element, or an intersection of edges segments of two or more other elements.

6. A structure formed by creating an un-nested assembly in accordance with claim 5, and applying a flexible cover over a plurality of the edge segments comprising the assembly.

7. A structure in accordance with claim 6 wherein the cover is hardened.

8. A structure in accordance with claim 6 wherein the cover is affixed to a plurality of the edge segments comprising the assembly.

9. A structure in accordance with claim 6 wherein a portion of the assembly is covered.

10. An assembly in accordance with claim 1, wherein one or more of said elements not confined to a plane.

11. An assembly in accordance with claim 10, wherein at least one element is in opposite chirality with at least one other element in the assembly.

12. A compound assembly comprising at least two assemblies in accordance with claim 1 that are linked together by at least one link.

13. A structure formed by casting wherein a mold is created using a burnable or meltable assembly in accordance with claim 1.

14. An assembly in accordance with claim 1, wherein the surfaces of the elements are colored, decorated, or numbered.

15. An assembly in accordance with claim 14, wherein one or more larger images or patterns are formed when the elements are arranged in certain orders.

16. An assembly in accordance with claim 1 further comprising:

at least four elements wherein each element nests against at most two of the other elements when in the nested configuration.

17. A nested structure comprising:

at least three elements, each element including an opening, each element comprises a plurality of edge segments, the edge segments being rigidly joined together at angular junctions and having at least two parallel substantially planar exterior surfaces extending between and forming a part of the angular junctions;

at least three links, each link defined by each opening receiving therethrough a single portion of each of the other elements;

wherein each link is maintained while the structure is converted from a first nested configuration through an unnested configuration to a second nested configuration;

wherein an edge segment of a first element nests against an edge segment of a second element in the first nested configuration and wherein the edge of the first element is separated from the edge of the second element in the second nested configuration; and wherein each edge segment that contacts an edge segment of another element is parallel to the edge segment of the another element.

18. A nesting structure in accordance with claim 17 further comprising:

at least four elements wherein each element nests against at most two of the other elements when in the first nested configuration and the second nested configuration.

* * * * *